US008511597B2

(12) United States Patent
Tada et al.

(10) Patent No.: US 8,511,597 B2
(45) Date of Patent: Aug. 20, 2013

(54) APPARATUS FOR FRACTURING POLYCRYSTALLINE SILICON AND METHOD FOR PRODUCING FRACTURED FRAGMENTS OF POLYCRYSTALLINE SILICON

(75) Inventors: Ryusuke Tada, Saitama (JP); Motoki Sato, Naka-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 13/282,523

(22) Filed: Oct. 27, 2011

(65) Prior Publication Data

US 2012/0104131 A1 May 3, 2012

(30) Foreign Application Priority Data

Oct. 28, 2010 (JP) ..... 2010-242063

(51) Int. Cl.
*B02C 13/00* (2006.01)
*B02C 13/09* (2006.01)
*B02C 13/20* (2006.01)

(52) U.S. Cl.
USPC ..... 241/187; 241/189.1; 241/191; 241/235; 241/295

(58) Field of Classification Search
USPC ..... 241/189.1, 187, 294, 295, 191, 235, 241/293
See application file for complete search history.

(56) References Cited

U.S. PATENT DOCUMENTS

| | | | | |
|---|---|---|---|---|
| 500,582 | A * | 7/1893 | Jones | 241/138 |
| 4,082,231 | A * | 4/1978 | Gould | 241/187 |
| 6,896,215 | B2 * | 5/2005 | Lucas et al. | 241/277 |
| 2006/0070569 | A1 | 4/2006 | Andrejewski et al. | |
| 2006/0088970 | A1 | 4/2006 | Hesse et al. | |
| 2009/0114748 | A1 | 5/2009 | Gruebl et al. | |

FOREIGN PATENT DOCUMENTS

| | | | |
|---|---|---|---|
| JP | 2006-122902 | A | 5/2006 |
| JP | 2006-192423 | A | 7/2006 |
| JP | 2009-531172 | A | 9/2009 |

* cited by examiner

*Primary Examiner* — Faye Francis
(74) *Attorney, Agent, or Firm* — Edwards Wildman Palmer LLP

(57) ABSTRACT

An apparatus for fracturing polycrystalline silicon having a pair of rolls which are rotated in a counter direction each other around parallel axes, the rolls is provided with: a plurality of disks layered along the axes of the rolls; and a plurality of fracturing teeth protruding radially-outwardly from the disks with a certain intervals along a peripheral direction of the disks, wherein the disks are rotated at different rotation speed from an adjacent disks, and the apparatus fracturing fragments of polycrystalline silicon between the rolls.

7 Claims, 4 Drawing Sheets

APPARATUS FOR FRACTURING POLYCRYSTALLINE SILICON AND METHOD FOR PRODUCING FRACTURED FRAGMENTS OF POLYCRYSTALLINE SILICON

CROSS REFERENCE TO RELATED APPLICATIONS

This application is related to four co-pending applications, all of them entitled, "APPARATUS FOR FRACTURING POLYCRYSTALLINE SILICON AND METHOD FOR PRODUCING FRACTURED FRAGMENTS OF POLYCRYSTALLINE SILICON" filed concurrently herewith as follows: in the names of Ryusuke Tada and Motoki Sato which claims priority to Japanese Patent Application No. 2010-242062 filed Oct. 28, 2010; in the names of Ryusuke Tada, Takahiro Matsuzaki, Shunsuke Kotaki and Motoki Sato which claims priority to Japanese Patent Application No. 2010-242061 filed Oct. 28, 2010; in the names of Takahiro Matsuzaki and Shunsuke Kotaki which claims priority to Japanese Patent Application No. 2010-242060 filed Oct. 28, 2010; and in the names of Takahiro Matsuzaki, Teruyoshi Komura, Shunsuke Kotaki and Motoki Sato which claims priority to Japanese Patent Application No. 2010-242059 filed Oct. 28, 2010, which co-pending applications are assigned to the assignee of the instant application and which co-pending applications are also incorporated by reference herein.

BACKGROUND OF THE INVENTION

1. Field of the Invention

The present invention relates to an apparatus for fracturing polycrystalline silicon which is raw material of semiconductor silicon or the like into fragments, and a method for producing fractured fragments of polycrystalline silicon using the apparatus for fracturing.

Priority is claimed on Japanese Patent Application No. 2010-242063, filed Oct. 28, 2010, the content of which is incorporated herein by reference.

2. Description of Related Art

A silicon wafer which is used for a semiconductor chip is manufactured from single-crystal silicon which is produced by, for example, Czochralski method ("CZ method"). For producing single-crystal silicon by the CZ method, for example, fractured fragments of polycrystalline silicon that is obtained by fracturing rod-shaped polycrystalline silicon formed by Siemens process is used.

For fracturing polycrystalline silicon, as shown in FIG. 4, a rod R of polycrystalline silicon is fractured to fragments C of a few millimeters to a few centimeters. In this process, it is typical to break the rod R into appropriate size by thermal shock or the like, and then further hit and break the fragments with a hammer directly. However, the process strains workers, so that it is inefficient to obtain fragments of appropriate size from rod-shaped polycrystalline silicon.

In Japanese Unexamined Patent Application, First Publication No. 2006-122902, a method for obtain silicon fragments by fracturing rod-shaped polycrystalline silicon with a roll-crasher is disclosed. The roll-crasher is a single-roll crasher in which one roll is stored in a housing and a plurality of teeth are formed on a surface of the roll. The roll-crasher fractures the rod-shaped polycrystalline silicon by collapsing between the teeth and an inner surface of the housing so as to impact the polycrystalline silicon continuously.

On the other hand, in Published Japanese Translation No. 2009-531172 of the PCT International Publication and Japanese Unexamined Patent Application, First Publication No. 2006-192423, apparatuses for fracturing roughly-crashed fragments of polycrystalline silicon are proposed. These apparatuses are double-roll crashers having two rolls and crashing the roughly-crashed fragments of polycrystalline silicon between the rolls.

SUMMARY OF THE INVENTION

Problems to be Solved by the Invention

Polycrystalline silicon can be efficiently fractured by the fracturing apparatuses mentioned-above. However, in the fracturing apparatus, when fragments of polycrystalline silicon are caught between the fracturing teeth which are arranged at even intervals, the fragments of crystalline silicon do not fall down even though the rolls are rotated, and carried again to the fracturing position. As a result, there is a case in which the fragments of crystalline silicon are in contact with newly added fragments and ground into powder.

The present invention is contrived in view of the circumstances, and an object of the present invention is to provide an apparatus for fracturing in which is prevented from clogging of polycrystalline silicon between the fracturing teeth, and which can fracture polycrystalline silicon into a desired size with preventing powder from generating and a method for fracturing polycrystalline silicon using the apparatus.

Means for Solving the Problem

An apparatus for fracturing polycrystalline silicon having a pair of rolls which are rotated in a counter direction each other around parallel axes, the rolls is provided with: a plurality of disks layered along the axes of the rolls; and a plurality of fracturing teeth protruding radially-outwardly from the disks with a certain intervals along a peripheral direction of the disks, wherein the disks are rotated at different rotation speed from an adjacent disks, and the apparatus fracturing fragments of polycrystalline silicon between the rolls.

By rotating the adjacent disks constructing the roll different rotating speeds, the arrangements of the fracturing teeth change at each the disk adjacent to each other along the axis direction. Therefore, the fractured fragments of polycrystalline silicon are prevented from being held between the fracturing teeth and can be reliably removed from between the fracturing teeth, so that polycrystalline silicon can be prevented from being fractured again or being ground. As a result, polycrystalline silicon can be fractured into the desired size and powder can be prevented from generating.

In the apparatus for fracturing polycrystalline silicon according to the present invention, it is preferable that the roll be constructed from laying a rotating disk which is rotationally-driven and a fixed disk which is not rotated alternately along the axis direction.

By adjoining the rotating disk and the fixed disk, the interval of the fracturing teeth between the adjacent disks can be easily changed.

In the apparatus for fracturing polycrystalline silicon according to the present invention, it is preferable that a top surface of the fracturing tooth be formed spherically, and a side surface of the fracturing tooth be formed cylindrically.

The top surfaces of the fracturing teeth are formed spherically, so that the top surfaces of the fracturing teeth and polycrystalline silicon are in contact at points. The side surfaces of the fracturing teeth are formed cylindrically, so that the side surfaces of the fracturing teeth and polycrystalline silicon are in contact in lines. Therefore, since the fracturing teeth and polycrystalline silicon are in contact at points or in lines, polycrystalline silicon can be prevented from being ground into powder by the fracturing teeth.

A method for producing fractured fragments of polycrystalline silicon according to the present invention products the fractured fragments of polycrystalline silicon by using the apparatus for fracturing polycrystalline silicon described above.

Effects of the Invention

According to the present invention, polycrystalline silicon can be fractured into desired size and powder can be prevented from being generated.

DESCRIPTION OF THE PREFERRED EMBODIMENTS

Hereinafter, an embodiment of an apparatus for fracturing polycrystalline silicon according to the present invention and a method for producing fractured fragments of polycrystalline silicon using the apparatus will be described with reference to the drawings.

Figure 1:
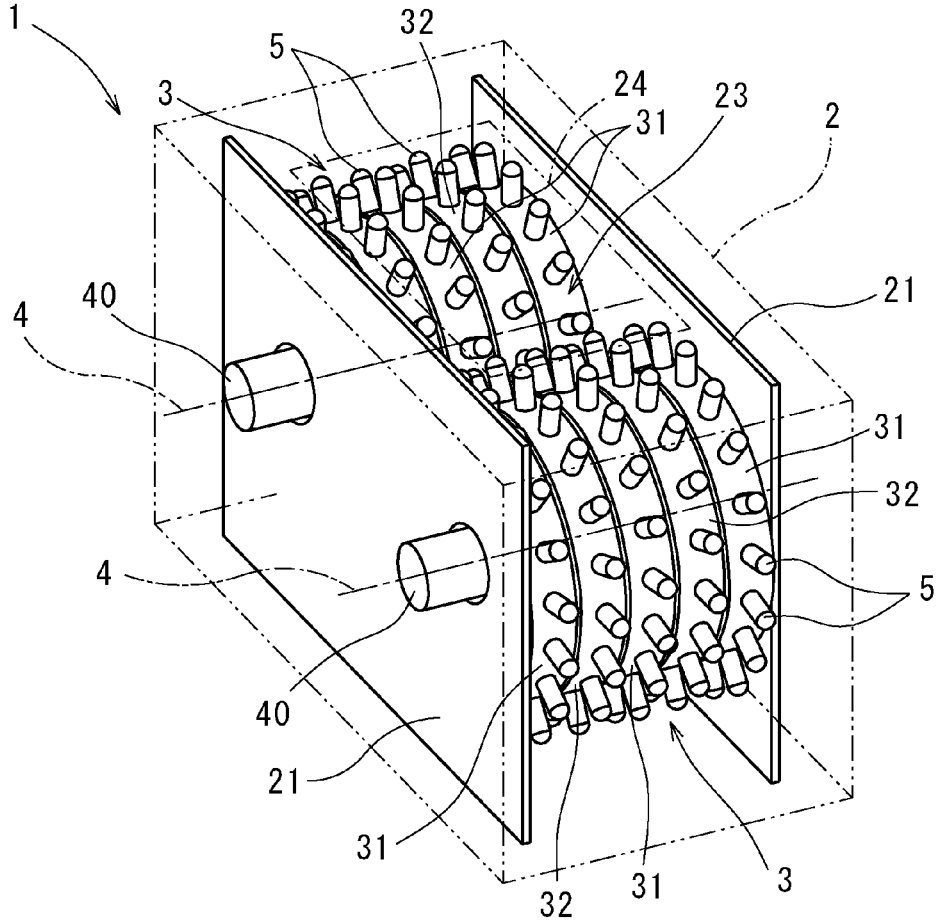
FIG. 1 is a partial perspective view showing an embodiment of an apparatus for fracturing polycrystalline silicon according to the present invention.

As shown in FIG. 1, an apparatus 1 for fracturing (hereinafter, "the fracturing apparatus 1") of a first embodiment is provided with two rolls 3 which are arranged in a housing 2 so that axes 4 of the rolls 3 are horizontal and parallel with each other.

Figure 2:
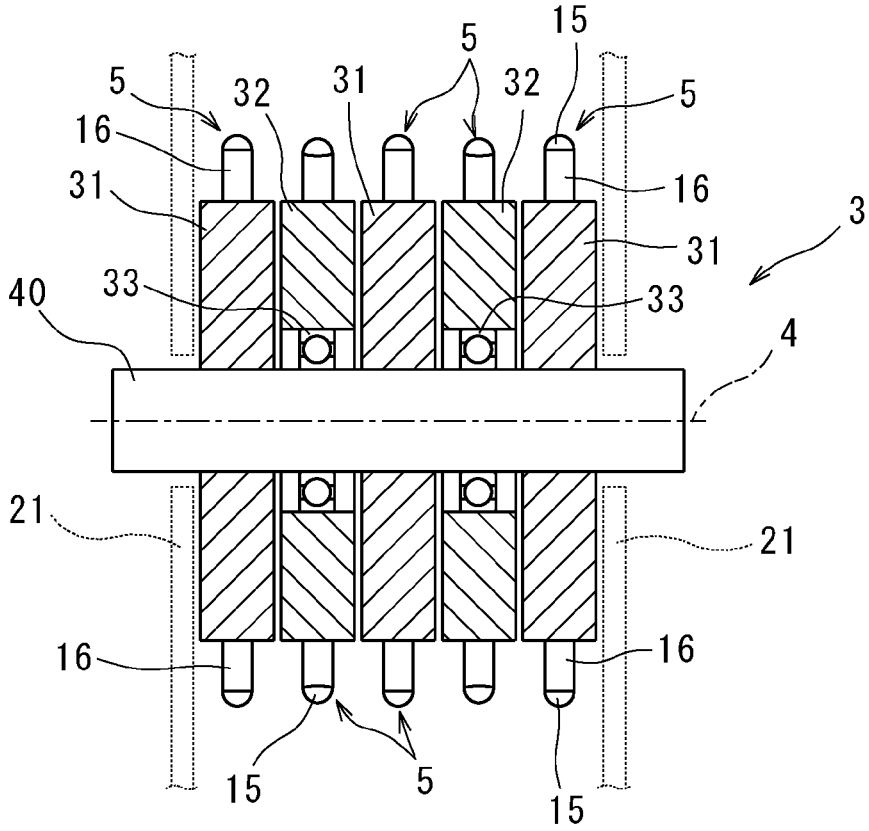
FIG. 2 is a vertical cross sectional view showing a roll.

As shown in FIG. 2, each of the rolls 3 is constructed by laying rotating disks 31 which are rotated around a rotation axis 4 and fixed disks 32 which are not rotated with respect to the rotation axis 4 alternately along the rotation axis 4. A rotation shaft 40 is inserted to a center of the layered rotating disks 31 and fixed disks 32.

The rotating disks 31 are fixed to the rotation axis 40, and rotated along with rotation of the rotation axis 40. The fixed disks 32 are held by bearings 33 so as to rotate freely and restricted to rotate, for example, by restriction parts (not illustrated) which are fixed to the housing 2.

The rotating disks 31 and the fixed disks 32 are, as shown in FIG. 1, on outer peripheral surfaces thereof, provided with fracturing teeth 5 with intervals so as to protrude radially-outwardly. The fracturing tooth 5 is formed from cemented carbide or silicon material. In the fracturing tooth 5, a top surface 15 is formed spherically and a side surface of a column part 16 is formed cylindrically.

Figure 3:
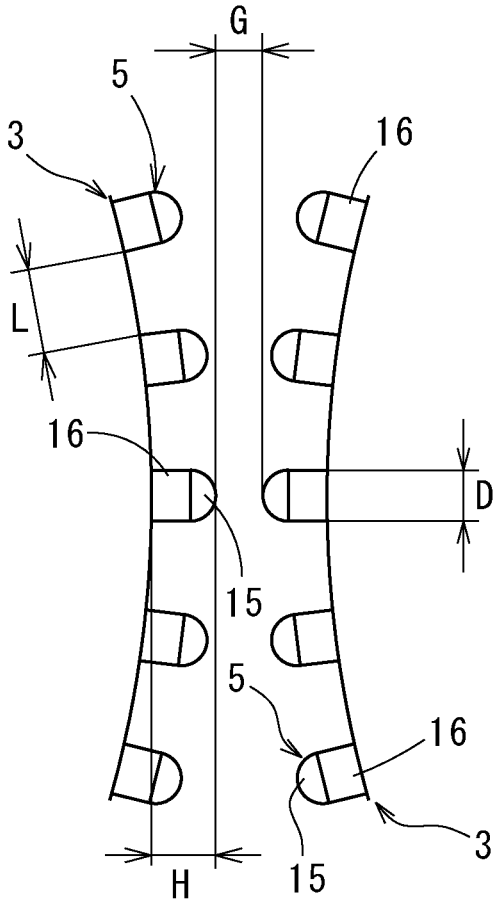
FIG. 3 is a front view showing a positional relation of the rolls at a facing part.
Figure 4:
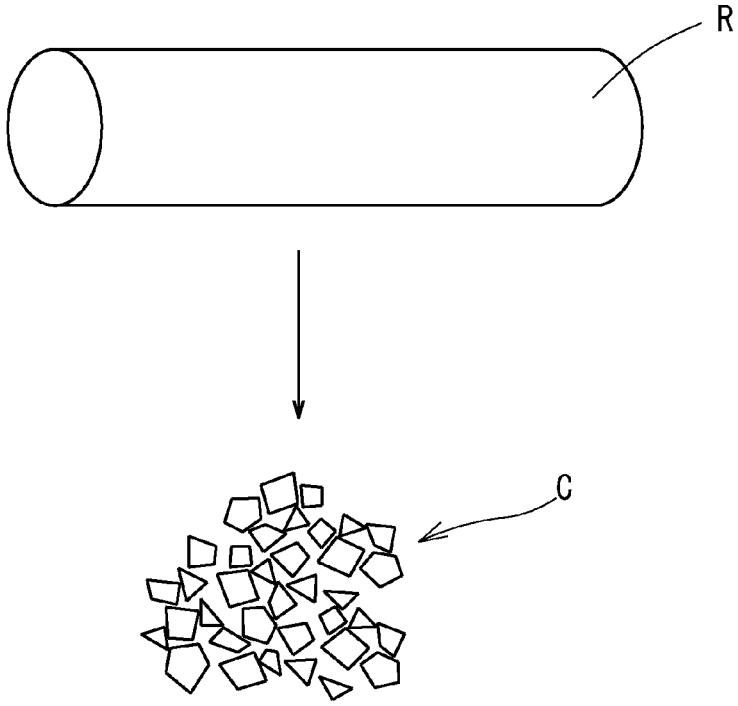
FIG. 4 is a schematic view showing fragments obtained by fracturing a rod of polycrystalline silicon.

In this embodiment, target size of fragments of polycrystalline silicon after fracturing (i.e., fractured fragments of polycrystalline silicon) is set in a range of 5 mm to 60 mm in maximum length. In order to obtain the fragments of such size: a diameter D of the column part 16 of the fracturing tooth 5 is set in a range of 10 mm to 14 mm; a protruding height H of the fracturing tooth 5 from the outer peripheral surface of the rotating disk 31 or the fixed disk 32 to a tip of the fracturing tooth 5 is set in a range of 20 mm to 30 mm, as shown in FIG. 3. A gap L between the adjacent fracturing teeth 5 of one disk is set in a range of 11 mm to 35 mm. Also, at the facing part of the rolls 3, a facing distance G between the top surfaces 15 of the fracturing teeth 5 is set in a range of 5 mm to 30 mm.

The housing 2 in which the rolls 3 are set is formed of resin such as polypropylene or the like, or formed of metal having an inner coating of tetrafluoroethylene in order to prevent contamination.

In the housing 2, a pair of partition plates 21 which are cross the axes 4 of the rolls 3 are provided in parallel each other with small intervals with respect to both sides of the rolls 3. The partition plates 21 are fixed to the housing 2, and form a fracturing space 23 for polycrystalline silicon at a facing space between the rolls 3 partitioned by the partition plates 21. On an upper surface of the housing 2, an inlet 24 is formed so as to be arranged immediately above the fracturing space 23.

The partition plates 21 are formed from resin such as polypropylene or the like or metal having inner coating of tetrafluoroethylene, as the housing 2. Also, the outer peripheral surfaces of the rotating disks 31 and the fixed disks 32 may be coated by polypropylene, tetrafluoroethylene or the like for preventing contamination.

The housing 2 is provided with a gearbox or the like (not shown) for rotary-driving the rolls 3. The gearbox is connected to an exhaust system (not shown) so as to exhaust the housing 2 and an inner space of the gearbox.

When fractured fragments of polycrystalline silicon is produced by using the fracturing apparatus 1 configured as described above, in a state of rolling the rolls 3, by supplying roughly-fractured polycrystalline silicon of appropriate size into the fracturing space 23 for polycrystalline silicon between the partition plates 21 through the inlet 24 of the housing 2, the fragments of polycrystalline silicon are further fractured into fragments between the fracturing teeth 5 of the rolls 3.

When fracturing, since the rotating disks 31 are rotated but the fixed disks 32 are fixed among the disks constructing the rolls 3, the arrangement of the fracturing teeth 5 of the adjacent fixed disks 32 and the rotating disks 31 along with the rotation of the rotating disks 31, so that gaps of the fracturing teeth 5 between the fixed disks 32 and the rotating disks 31. Therefore, the fragments of polycrystalline silicon fractured here are not held between the fracturing teeth 5 of the disks and are reliably removed from between the fracturing teeth 5 along with the rotation of the rotating disks 31. Consequently, the fracturing teeth are not rotated with sticking polycrystalline silicon therebetween, so that the fragments between the fracturing teeth 5 can be reliably removed before fractured again. Therefore, polycrystalline silicon can be prevented from being fracture again or being ground, so that powder can be prevented from being generated. As a result, the loss rate can be reduced and polycrystalline silicon can be efficiently fractured into fragments of appropriate size.

In the fracturing teeth 5, the top surfaces 15 are formed spherically, so that the top surfaces 15 and polycrystalline silicon are in contact at points. Also, in the fracturing teeth 5, the side surfaces of the column parts 16 are formed cylindrically, so that the side surfaces and polycrystalline silicon are in contact at points or in lines. Therefore, the fracturing teeth 5 impact polycrystalline silicon in a state of being in contact with polycrystalline silicon at points or in lines, so that polycrystalline silicon can be prevented from being crushed by planes.

The partition plates 21 which are arranged above the ends of the rolls 3 prevent the fragments of polycrystalline silicon which are fractured therebetween from being ground by entering between the inner wall surfaces of the housing 2 and the end surfaces of the rolls 3. Therefore, the fragments of polycrystalline silicon can be reliably fractured and pass through between the rolls 3.

As a result, in the fracturing apparatus 1, polycrystalline silicon can be fractured to of desired size, so that the powder can be prevented from being generated and the loss rate can be reduced.

Furthermore, in the fracturing apparatus 1, since the fracturing teeth 5 are formed from cemented carbide or silicon material, impurities are prevented from contaminating polycrystalline silicon from the fracturing teeth 5. Furthermore, the partition plates 21 and the housing 2 surrounding the fracturing space 23 for polycrystalline silicon are made from resin such as polypropylene or the like, or are coated by tetrafluoroethylene. Therefore, polycrystalline silicon can be prevented from being contaminated by impurities while fracturing. As a result, according to the fracturing apparatus 1, high-quality polycrystalline silicon for semiconductor material can be obtained.

The present invention is not limited to the above-described embodiments and various modifications may be made without departing from the scope of the present invention.

In the above embodiment, the rolls are constructed from laying the rotating disks and the fixed disks alternately so as not to rotate the fixed disks. However, It is not necessary to fix some disks, if the rotation speeds of the adjacent disks can be changed with each other, since the gaps between the adjacent fracturing teeth can be changed. For example, the adjacent disks may be rotated at different speed, or the adjacent disks may be rotated at opposite directions.

The side surfaces of the column parts of the fracturing teeth are formed cylindrically in the above embodiments. However, the side surfaces may be formed conically. Furthermore, the tips of the fracturing teeth may be formed conically so as to be connected with the spherical top surfaces and a cylindrical base part.

It is not necessary that all the protruding height of the fracturing teeth are the same. The fracturing teeth having different protruding heights can be intermixed.

Also, dimensions of the facing gaps or the like of the fracturing teeth are not limited to the above-described embodiments.

What is claimed is:

1. An apparatus for fracturing polycrystalline silicon comprising a pair of rolls which are rotated in a counter direction each other around parallel axes, the rolls is provided with:

rotating disks which are rotationally-driven and fixed disks which are not rotated alternately layered along the axes of the rolls; and a plurality of fracturing teeth protruding radially-outwardly from the disks with a certain intervals along a peripheral direction of the disks, wherein the apparatus fractures fragments of polycrystalline silicon between the rolls.

2. The apparatus for fracturing polycrystalline silicon according to claim 1, wherein top surfaces of the fracturing teeth are formed spherically, and side surfaces of the fracturing teeth are formed cylindrically.

3. A method for producing fractured fragments of polycrystalline silicon using the apparatus for fracturing polycrystalline silicon according to claim 1.

4. The apparatus for fracturing polycrystalline silicon according to claim 1, wherein the rotating disks are fixed to a rotation shaft which is inserted to a center of the rotating disks and the fixed disks, so that the rotating disks are rotated along with rotation of the rotation shaft, and the fixed disks are held by bearings so as not to be rotated along with the rotation of the rotation shaft and restricted by restriction parts which are fixed to a housing in which the rolls are arranged therein.

5. The apparatus for fracturing polycrystalline silicon according to claim 1, wherein side surfaces of the fracturing teeth are formed conically.

6. The apparatus for fracturing polycrystalline silicon according to claim 1, wherein tips of the fracturing teeth are formed conically so as to be connected with spherical top surfaces and cylindrical base parts of the fracturing teeth.

7. The apparatus for fracturing polycrystalline silicon according to claim 1, wherein the rolls are provided with the fracturing teeth having different protruding heights intermixed.

* * * * *